US008936166B2

(12) United States Patent
Hornsby

(10) Patent No.: US 8,936,166 B2
(45) Date of Patent: Jan. 20, 2015

(54) COLLAPSIBLE AND STACKABLE GARMENT RAIL ASSEMBLY

(75) Inventor: Thomas Stephen Hornsby, London (GB)

(73) Assignee: The Garment Rail Company Limited, London (GB)

( * ) Notice: Subject to any disclaimer, the term of this patent is extended or adjusted under 35 U.S.C. 154(b) by 72 days.

(21) Appl. No.: 13/137,953

(22) Filed: Sep. 22, 2011

(65) Prior Publication Data

US 2012/0074082 A1 Mar. 29, 2012

(30) Foreign Application Priority Data

Sep. 24, 2010 (GB) ..... 1016124.8
Feb. 9, 2011 (GB) ..... 1102259.7

(51) Int. Cl.

| | |
|---|---|
| ***A47F 7/00*** | (2006.01) |
| ***A47G 25/06*** | (2006.01) |
| *A47B 43/00* | (2006.01) |
| *A47B 47/00* | (2006.01) |
| *A47F 5/14* | (2006.01) |
| *B62D 39/00* | (2006.01) |
| *B62B 1/00* | (2006.01) |
| *A47F 7/24* | (2006.01) |

(52) U.S. Cl.

CPC ..... *A47G 25/0685* (2013.01); *A47F 7/24* (2013.01)

USPC ..... 211/85.3; 211/195; 211/204; 211/182; 280/33.998; 280/639; 280/651

(58) Field of Classification Search

USPC ..... 211/85.3, 195, 204, 199, 200, 189, 207, 211/206, 183, 182, 201; 280/33.998, 639, 280/651

See application file for complete search history.

(56) References Cited

U.S. PATENT DOCUMENTS

| | | | | | |
|---|---|---|---|---|---|
| 594,433 | A | * | 11/1897 | Sheldon | 211/20 |
| 1,008,477 | A | * | 11/1911 | Korn | 211/204 |
| 1,015,448 | A | * | 1/1912 | Madden | 211/182 |
| 1,510,272 | A | * | 9/1924 | Harmount | 211/204 |
| 1,753,725 | A | * | 4/1930 | Solomon et al. | 211/182 |
| 1,830,282 | A | * | 11/1931 | Lorch | 211/204 |
| 2,748,955 | A | * | 6/1956 | Anselmo | 211/204 |
| 2,793,764 | A | * | 5/1957 | Stork | 211/204 |
| 2,885,090 | A | * | 5/1959 | Forman et al. | 211/175 |
| 3,092,408 | A | * | 6/1963 | Berman | 403/306 |
| 3,503,525 | A | * | 3/1970 | Loebner | 211/206 |
| 3,863,769 | A | * | 2/1975 | Goddard | 211/182 |
| 3,918,591 | A | * | 11/1975 | Cooper | 211/204 |
| 4,555,029 | A | * | 11/1985 | Fiol | 211/22 |
| 4,934,015 | A | * | 6/1990 | Mink | 15/268 |
| 5,617,962 | A | * | 4/1997 | Chen | 211/206 |

(Continued)

FOREIGN PATENT DOCUMENTS

| | | |
|---|---|---|
| EP | 1 702 538 | 9/2006 |
| NL | 1030650 | 6/2007 |
| WO | WO 03/094676 | 11/2003 |

OTHER PUBLICATIONS

UK Search Report for GB Application No. 1102259.7, dated Jun. 9, 2011.

*Primary Examiner* — Joshua J Michener
*Assistant Examiner* — Devin Barnett
(74) *Attorney, Agent, or Firm* — Nixon & Vanderhye P.C.

(57) ABSTRACT

The present invention relates to a collapsible garment rail assembly that can be stacked with similar garment rail assemblies.

12 Claims, 2 Drawing Sheets

(56) References Cited

U.S. PATENT DOCUMENTS

| | | | | |
|---|---|---|---|---|
| 5,718,344 | A * | 2/1998 | Joldeson et al. | 211/206 |
| 5,755,342 | A * | 5/1998 | Hoffman | 211/64 |
| 6,264,047 | B1 * | 7/2001 | Crumley | 211/189 |
| 6,401,948 | B1 * | 6/2002 | Huang | 211/206 |
| 6,488,160 | B2 * | 12/2002 | Wang | 211/195 |
| 6,644,484 | B1 * | 11/2003 | Sardis | 211/190 |
| 7,104,412 | B2 * | 9/2006 | Yong | 211/206 |
| 7,438,195 | B2 * | 10/2008 | Beck | 211/194 |
| 7,654,036 | B2 * | 2/2010 | Shouse et al. | 47/39 |
| 7,946,434 | B1 * | 5/2011 | Greenspon | 211/85.3 |
| 8,210,374 | B2 * | 7/2012 | Harpole | 211/195 |
| 8,342,544 | B1 * | 1/2013 | Blewett et al. | 280/79.11 |
| 2002/0005389 | A1 * | 1/2002 | Guo | 211/85.3 |
| 2002/0079277 | A1 * | 6/2002 | Huang | 211/206 |
| 2002/0121493 | A1 * | 9/2002 | Wang | 211/195 |
| 2006/0065615 | A1 | 3/2006 | Wang | |
| 2006/0091096 | A1 * | 5/2006 | Velez et al. | 211/194 |
| 2007/0163974 | A1 * | 7/2007 | Lai | 211/85.3 |
| 2007/0272642 | A1 * | 11/2007 | Baptiste | 211/201 |
| 2008/0029473 | A1 * | 2/2008 | Hu | 211/206 |
| 2008/0217276 | A1 * | 9/2008 | Brady et al. | 211/195 |
| 2008/0237168 | A1 * | 10/2008 | Harpole | 211/195 |
| 2011/0114581 | A1 * | 5/2011 | Greenspon | 211/85.3 |

* cited by examiner

COLLAPSIBLE AND STACKABLE GARMENT RAIL ASSEMBLY

This application claims priority to GB Application No. 1016124.8, filed 24 Sep. 2010; and GB Application No. 1102259.7, filed 9 Feb. 2011, the entire contents of each of which are hereby incorporated by reference.

FIELD OF INVENTION

The present invention relates to a collapsible and stackable garment rail assembly.

BACKGROUND

Collapsible garment rails assemblies are known in the market. The rail assemblies are often used by film and TV costumiers within the film and TV industry, and are also often used in the fashion and retail industries.

Existing garment rail assemblies used are not robust enough or wide enough for the weight that is currently applied to them, resulting in the assemblies falling over regularly, or bending and breaking. The wheels of existing garment rail assemblies also work loose and come off regularly, and are not easy to refit. In addition, the rail assemblies are finished in a paint finish that often scratches off and the rails become rusty. When collapsing the rails assemblies into four separate parts for the regular purpose of transporting them, this often results in rail bars being misplaced with other rail assemblies, and bars hitting people when people are not exercising caution. Therefore, there are health and safety issues with the existing rail assemblies, and from a financial point of view, these rail assemblies only last one or two jobs at the most before breaking.

It is an object of the present invention to provide a collapsible and stackable garment rail assembly which overcomes the disadvantages of the prior art, or at least provides a useful alternative.

SUMMARY OF INVENTION

According to an aspect of the invention there is provided a garment rail assembly capable of being stacked on by a similar garment rail assembly, comprising: a base unit comprising a base member and two transverse members, each transverse member having a first stacking member and a second stacking member, said second stacking member including a bracket; a pair of support members, each support member pivotally connected to the base unit; and a garment rail having a pair of attachment means and a pair of brackets; wherein, in an assembled position, each support member is pivoted perpendicular to said base unit and said garment rail is engaged to each support member via said attachment means, and, in a collapsed position, said garment rail is engaged to each of the first stacking members via said attachment means and said garment rail assembly is configured to support transverse members of a similar garment rail assembly via said second stacking member brackets and said garment rail brackets.

Other aspects of the invention are described within the claims.

BRIEF DESCRIPTION OF THE DRAWINGS

Embodiments of the invention will now be described, by way of example only, with reference to the accompanying drawings in which.

DETAILED DESCRIPTION OF PREFERRED EMBODIMENTS

The present invention generally relates to a garment rail assembly that can be collapsed and in collapsed form be stacked onto by other collapsed garment rail assemblies.

Figure 1:
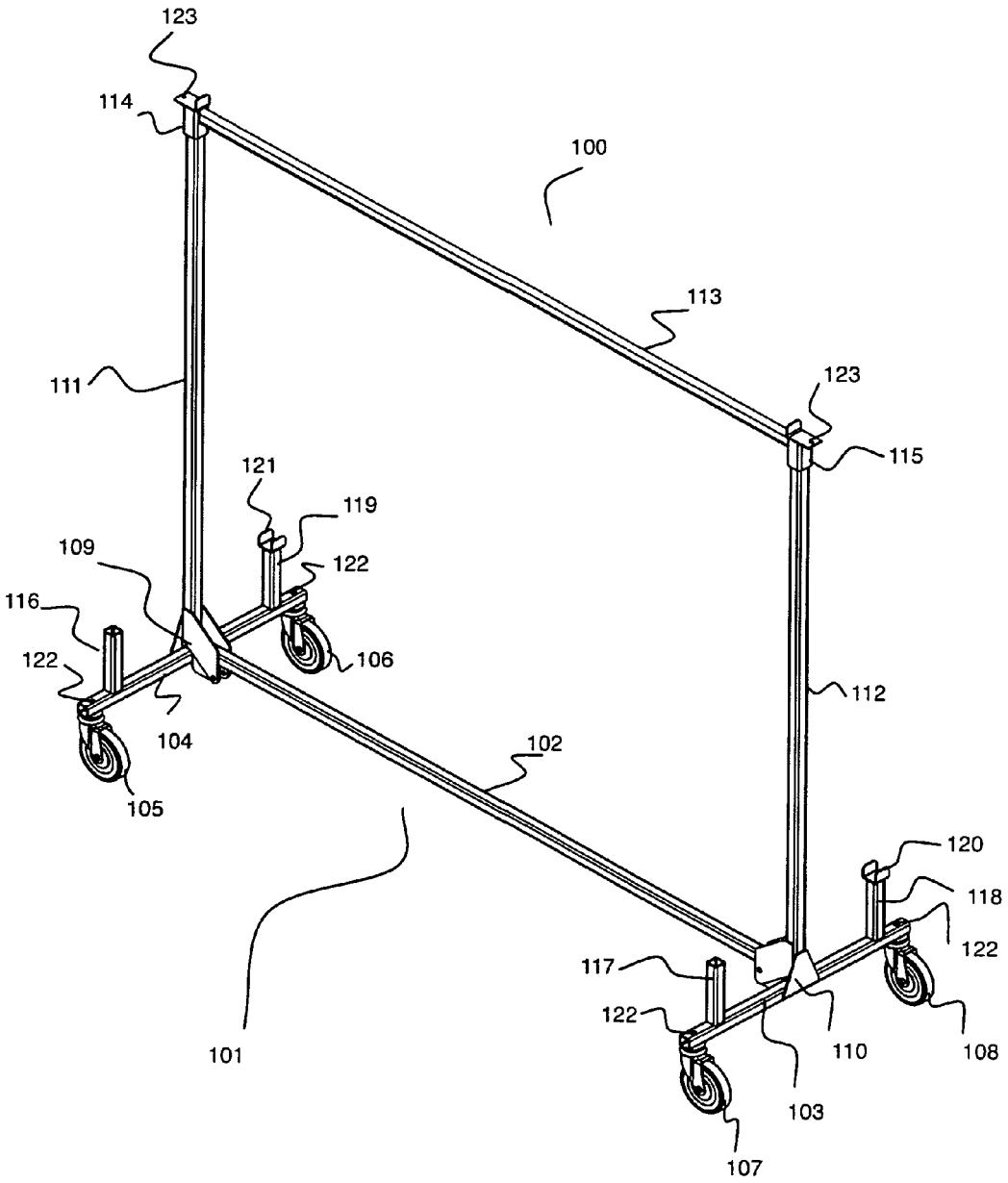
FIG. 1: shows diagrammatically an isometric view of a collapsible and stackable garment rail assembly in an assembled position, in accordance with an embodiment of the invention.
Figure 2:
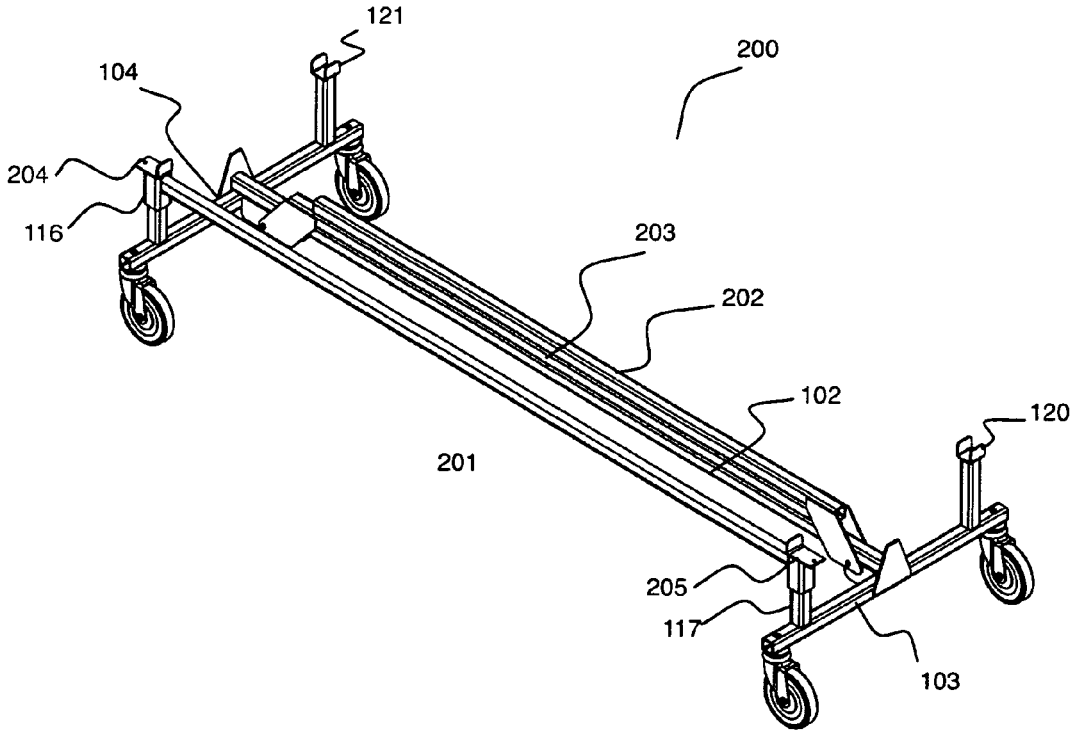
FIG. 2: shows diagrammatically an isometric view of a collapsible and stackable garment rail assembly in a collapsed position, in accordance with an embodiment of the invention.

Referring to FIGS. 1 and 2, an embodiment of the garment rail assembly will be described.

FIG. 1 shows the garment rail assembly 100 in an assembled position.

The garment rail assembly 100 includes a base unit 101 comprising a base bar 102 and two cross bars 103, 104. Swivel castor wheels 105, 106, 107, 108 attached to the base unit 101 at the underside of each end of the cross bars 103, 104.

At the intersection of each cross bar 103, 104 and the base bar 102 is a pivot 109, 110 connecting a folding leg 111, 112 to the base unit 101.

The folding legs 111, 112 in an upright position are configured to engage with a removable top rail 113. The top rail 113 fits over the ends of the folding legs 111, 112 using an attachment socket 114, 115 at either end of the top rail 113. As an alternative, another attachment means, instead of a socket, could also be used, such as a side clip or a claw clamp. If a claw clamp is used, the claw clamps may be fixed in a sideways position at each end of bar 113. To release the claw clamp, a sliding switch may be utilised. When a claw clamp is used, the folding legs may be round or oval in cross-section to assist in the claw clamp obtaining grip. Furthermore, the folding legs may include a collar to prevent the claw clamp sliding down the legs.

Near the ends of each cross bar 103, 104 on the upper side are upright posts 116, 117, 118, 119. Two corresponding posts 118, 119 on the cross bars 103, 104 each include a bracket 120, 121 sized to receive a cross bar of another garment rail and arranged to inhibit horizontal movement perpendicular to the cross bar 103, 104 length. The brackets 120, 121 may be U-shaped.

The top rail 113; base bar 102; cross bars 103, 104; and folding legs 111, 112 may be made out of hollow square steel. In an alternative embodiment, the top rail is oval or round to permit ease of hanger movement. In a yet further embodiment, all the top rail 113; base bar 102; cross bars 103, 104; and folding legs 111, 112 may be oval or round.

The swivel castors 105, 106, 107, 108 may include bolts 122 that fit into the top of the cross bars and are accessible to enable easy tightening of loose wheels. The swivel castors 105, 106, 107, 108 may also include brakes to inhibit rolling movement of the garment rail assembly 100. The brakes may be arranged only on one pair of diagonally opposite swivel castors such as 105, 108 or 106, 107 to sufficiently effect inhibition of rolling movement.

The top rail 113 may be made of stainless steel to avoid the problem of scratched paint and rust.

The top rail 113 may include screw holes 123 at each end for the addition of "screw in" rail placards. It can be seen that the rail placards can stay in place when the garment rail assembly 200 is in a collapsed position.

In an alternative embodiment, extension bars may be attached to the ends of the folding legs 111, 112 to raise the top rail 113 providing greater height and ground clearance for long garments when desired.

In FIG. 2 the garment rail assembly 200 is shown in a collapsed position.

In the collapsed position, the top rail 201 is removed from the tops of the folding legs 202, 203 and placed onto the stacking posts 116, 117 on the cross bars 103, 104.

Each folding leg 202, 203 is pivoted to lie flat above the base bar 102.

In a collapsed position, each end of the top rail 201 forms a bracket 204, 205 on top of each stacking post 116, 117. The top rail brackets 204, 205 are configured to receive a cross bar of another garment rail assembly and to inhibit horizontal movement of said garment rail assembly perpendicular to the length of the cross bar 103, 104. Preferably the brackets 204, 205 are L-shaped.

Accordingly, in a collapsed position, the garment rail assembly 200 provides four stacking brackets 204, 205, 120, 121 configured to receive cross bars of another, similarly configured garment rail assembly. It can be seen that said similar garment rail assembly can be stacked on top of the garment rail assembly 200 using the brackets 204, 205, 120, 121, and that the configuration of the brackets 204, 205, 120, 121 will prevent horizontal movement perpendicular to the cross bar 103, 104. Furthermore, wheels of the stacked garment rail assembly may inhibit horizontal movement along the cross bar 103, 104. Alternatively, or in addition, raised lips or bolts may be provided on the underside of the cross bars of the stacked unit such that the raised lips or bolts interact with the brackets 204, 205, 210, 121 of garment rail assembly 200 to inhibit horizontal movement along the cross bar 103, 104. Therefore, the stacked garment rail assembly is reasonably secure and the stacked unit of garment rail assemblies can be safely rolled for deployment or storage.

The inventor has discovered that the garment rail assemblies can be safely stacked up to five garment rail assemblies high without compromising the structural integrity of the stacked unit.

In an alternative embodiment, one or more stacking posts and brackets may be replaced with alternative support means such as socket and post system. In such an embodiment, the underside of the cross bars may include a corresponding post or socket, and the brackets of the garment rail may be replaced with a corresponding post or socket. The support means of two garment rail assemblies can then engage when one is stacked upon the other to maintain structural integrity of the stacked unit.

In a further embodiment, the stacking posts with brackets may be pivotally attached to the cross bars such that in a first position the stacking posts are perpendicular to the cross bars and in a second position the stacking posts are parallel to the cross bars with the brackets directed away from the folding leg pivots. The stacking posts may be secured in the perpendicular position using a spring catch. In the perpendicular position, the stacking posts can assist in engaging with a stacked garment rail assembly. In a parallel position, the stacking posts can provide a sideways bracket can that engage with an adjacent garment rail assembly to provide some structural integrity to a unit of adjacent garment rail assemblies. It can be seen that the bracket may, advantageously, engage with the ends of the cross bars of the adjacent garment rail assembly. Preferably, the stacking post is a square post open on two opposite sides to enable the post to fit over the cross bar in the parallel position.

Potential advantages of embodiments of the invention are that the garment rail assembly can collapse down into one structural unit, that similar garment rail assemblies can now be stacked onto one another and can be moved easily when collapsed and/or stacked, that the garment rail assembly resists bending and breakage when loaded, and that the garment rail assembly resists scratches and rust.

It will readily be appreciated that other materials for construction may be used such as aluminium, or that some components may be made of aluminium and some of steel.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus and method, and illustrative examples shown and described. Accordingly, departures may be made from such details without departure from the spirit or scope of applicant's general inventive concept.

The invention claimed is:

1. A garment rail assembly capable of being stacked on by a similar garment rail assembly, comprising:

a base unit comprising a longitudinally extending base member having two ends, a transverse member connected to each end of the base member, each transverse member having a first stacking member and a second stacking member extending upwardly from a top surface of each transverse member, the first stacking members each comprising a first post having a first height, the second stacking members each comprising a second post having a second height that is greater than the first height and (a) one of a socket and a post end attached to the corresponding second posts of the second stacking members, said one of the socket and the post end being adapted to mate with the other of the socket and post end disposed on an underside of the transverse member or (b) a stacking bracket attached to the corresponding second posts of the second stacking members, said stacking brackets each having a horizontal flange bottom and at least one vertical flange extending perpendicular from the horizontal flange bottom; a plurality of wheels extending below the base unit:

a pair of support members, each support member pivotally connected to the base unit at opposite ends of the base unit; and a top rail having a pair of attachment sockets attached to opposite ends of the top rail, the attachment sockets each including a hollow bottom and a bracket at a top portion of the respective attachment sockets, the brackets of the attachment sockets each having a horizontal flange bottom and at least one vertical flange extending perpendicular from the horizontal flange bottom; wherein:

in an assembled position, each support member is pivoted upwardly to a position that is perpendicular to said base unit and a top end of each support member is inserted within a corresponding hollow bottom of a respective attachment socket of said top rail so that the top rail is mounted to and extends between the top ends of each support member in order to hang garments from the top rail and the attachment sockets are disengaged from each of the first stacking members, in a collapsed position, said top rail and said attachment sockets are removed from the top ends of the pair of supports, the pair of supports are each pivoted downward to a position substantially parallel with the base member, and a top end of each first post of the corresponding first stacking members is inserted within a corresponding hollow bottom of a respective attachment socket of said top rail so that the top rail is mounted to and extends between the top ends of each first post of the first stacking members, and the horizontal flange bottoms of each attachment socket and each stacking bracket are all level at the same height in order to stack the similar garment rail assembly on top said garment rail assembly in a level manner by placing a bottom side of transverse members of the similar garment rail assembly on top of each horizontal flange of the corresponding attachment sockets and stacking brackets.

2. A garment rail assembly as claimed in claim 1 wherein the plurality of wheels are mounted on an under side of said transverse members.

3. A garment rail assembly as claimed in claim 2 wherein the plurality of wheels includes at least two wheels mounted on the under side of each of the transverse members.

4. A garment rail assembly as claimed in claim 3 wherein two of the plurality of wheels diagonally opposite one another each comprises a wheel brake.

5. A garment rail assembly as claimed in claim 1 wherein the garment rail is made of stainless steel.

6. A garment rail assembly as claimed in claim 1 where said support members are pivotally connected to the base unit at a first end and said attachments engage with the opposite ends of said support members.

7. A garment rail assembly as claimed in claim 1 wherein said pair of brackets are each L-shaped.

8. A garment rail assembly as claimed in claim 1 wherein said stacking brackets are U-shaped.

9. A garment rail assembly as claimed in claim 1, wherein the pair of support members are pivoted towards one another to transition to the collapsed position and the pair of support members are pivoted away from one another to transition to the assembled position.

10. A garment rail assembly as claimed in claim 1, wherein the support members are vertically stacked upon one another in the collapsed position.

11. A garment rail assembly as claimed in claim 1, wherein:

the base unit has a length and a width, the top rail is disposed substantially parallel to the length in the assembled position and the collapsed position, the top rail is disposed substantially at a midpoint along the width in the assembled position, and the top rail is disposed offset from the midpoint of the width in the collapsed position.

12. A garment rail assembly as claimed in claim 1, wherein the first stacking member and the second stacking member are offset inwards from the wheels such that a wheel of the similar garment rail is adjacent to each of the first stacking members and the second stacking members in a stacked condition.

* * * * *